United States Patent [19]

Mercer, II et al.

[11] Patent Number: 4,874,123

[45] Date of Patent: Oct. 17, 1989

[54] GUTTER INSTALLATION TOOL

[76] Inventors: Roger W. Mercer, II, Rte. 2, Box 236, Marshall, Va. 22115; Roger W. Mercer, 1340 Arlington Dr., Fairborn, Ohio 45324

[21] Appl. No.: 272,348

[22] Filed: Nov. 17, 1988

[51] Int. Cl.[4] ..... B25C 1/02

[52] U.S. Cl. ..... 227/147; 227/156

[58] Field of Search ..... 227/147, 149, 156, 148

[56] References Cited

U.S. PATENT DOCUMENTS 4,733,812 3/1988 Lewis et al. ..... 227/147

*Primary Examiner*—Paul A. Bell

*Attorney, Agent, or Firm*—Louis E. Hay

[57] ABSTRACT

A gutter installation tool for positioning on a gutter and detachably holding a ferrule in position within the gutter while also detachably holding a nail external to the gutter, the nail being in longitudinal alignment with the ferrule, thus eliminating the need for the gutter installer to hold the ferrule and the nail when installing the gutter. After the nail enters the structure to which the gutter is being insatlled, the gutter installation tool is detached from the gutter, and the nail is driven to its final position.

3 Claims, 2 Drawing Sheets

GUTTER INSTALLATION TOOL

BACKGROUND OF THE INVENTION

Attaching a gutter to a building is one of those tasks which appears to be very easy; however, this task has inherent problems. One problem is that the person installing the gutter should have more hands because: (1) the gutter must be sloped at an angle which will provide proper drainage to the downspout; (2) the installer must hold the loose ferrule in place within the gutter; (3) the installer must hold the nail, or spike, at the outside of the gutter; and (4) the installer must drive the nail through the gutter and the ferrule.

On many relatively low structures, such as a single story dwelling, gutters are most easily installed by two persons working as a team. One person works from the roof while the other person works from a ladder. Between the two persons, they have four hands and can install the gutter. Installation of gutters is much more difficult on multi-story buildings, and especially those buildings having steep roofs.

As will be seen from the drawings and the specification below, the applicants have invented a novel and useful gutter installation tool which will greatly facilitate the installation of gutters.

DESCRIPTION OF THE PREFERRED EMBODIMENT

Figure 1:
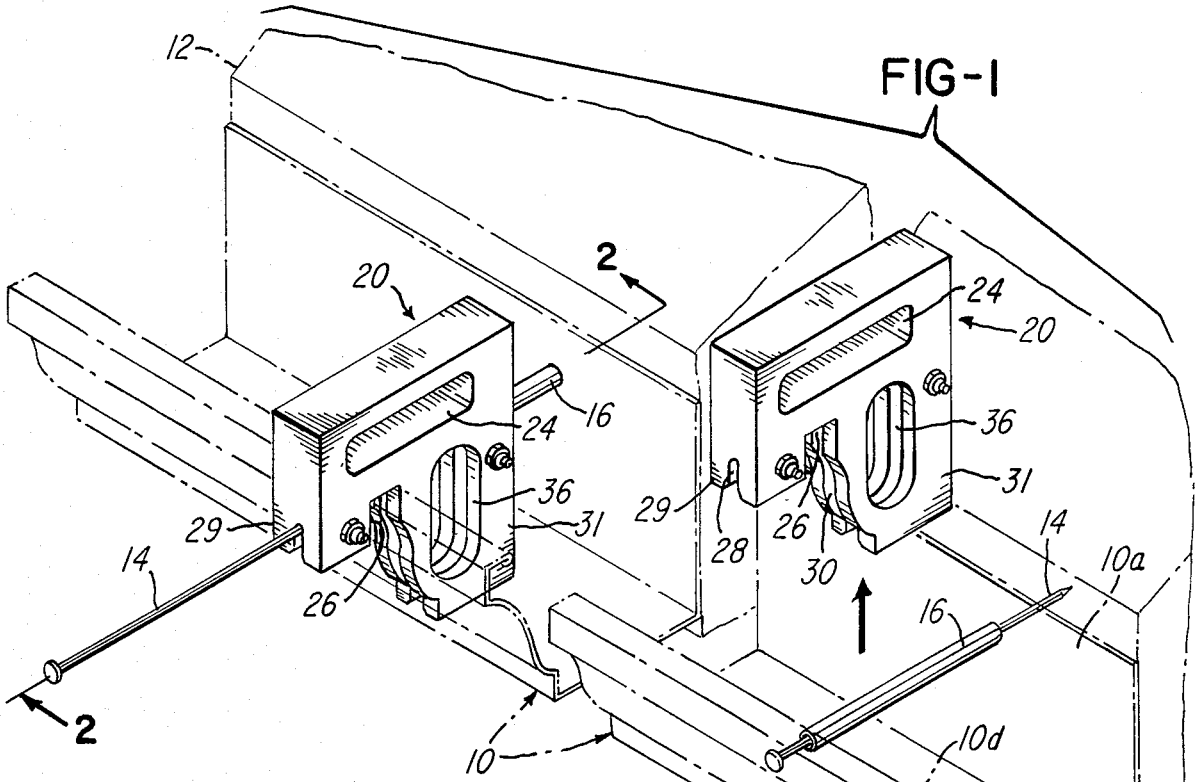
FIG. 1 is a perspective depicting use of the gutter installation tool.

FIG. 1 depicts a portion of a conventional gutter 10 in phantom lines, the gutter itself not constituting an element of the invention. The gutter 10 is to be attached to a portion of building 12 below the roof line where it is positioned to carry away the water draining from the roof of the building.

The gutter has a flat upright back side 10*a* for abutting against the building portion 12, a bottom side 10*b*, and an ogee 10*c* which terminates at the upper end in flange 10*d*.

The gutter is attached to the building by means of long nails or spikes 14 which pass through ferrules 16 which are used to prevent distortion of the gutter when the nails are driven in place.

Figure 2:
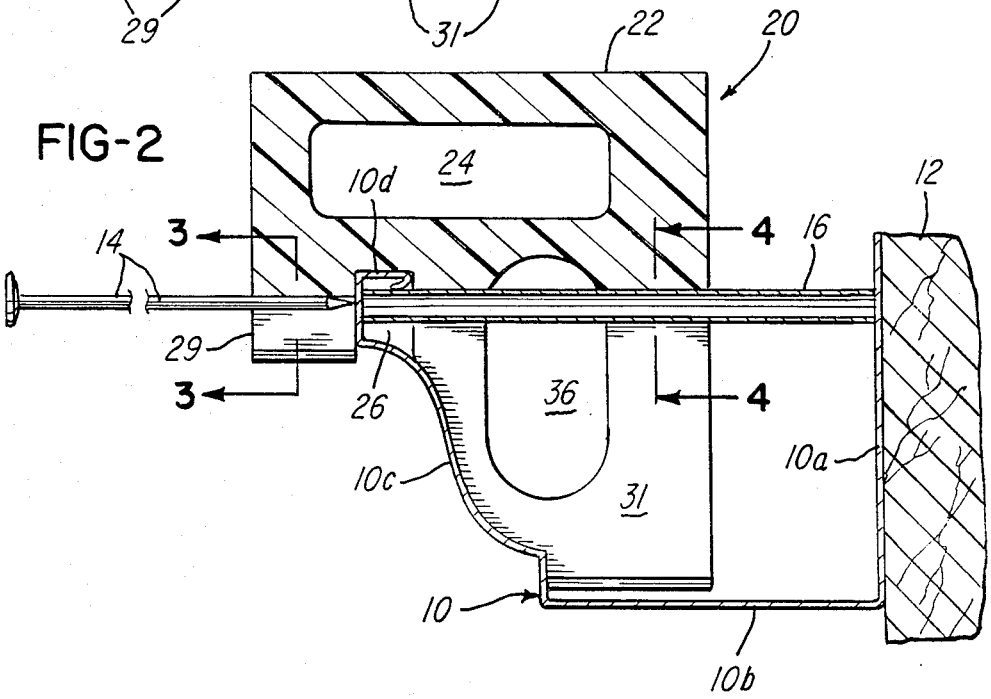
FIG. 2 is a vertical cross-section along line 2—2 of FIG. 1 and depicting one species of the tool positioned in the gutter and holding a ferrule and a nail positioned for installation of the gutter.

The gutter installation tool 20, depicted in FIGS. 1 and 2, is one species of the invention, and is positioned on the gutter as depicted in the left portion of FIG. 1 and in FIG. 2. By means, which will be further described below, the installation tool 20 detachably holds and positions a nail or spike 14 to be outside of the gutter, and a ferrule 16 to be within the gutter as best seen in FIG. 2.

After the nail 14 is driven to pierce the gutter, pass through the ferrule 16, and be partially driven into the building structure 12, the installation tool 20 is lifted from the gutter as depicted in the right portion of FIG. 1. After the installation tool is lifted from the gutter, the remaining portion of the nail is driven until the nail head is firmly against the gutter with the ferrule preventing distortion of the installed gutter.

The gutter installation tool 20, as depicted in FIGS. 1 and 2, in many ways has the general appearance of the handle on a conventional hand saw. The tool has a handle 22 having an aperture 24 permitting the tool to be grasped in the conventional hand saw manner when the tool is inserted in, or is removed from the gutter.

That portion of the tool which is downward extending from the handle portion is contoured to substantially fit the ogee of the gutter as is best depicted in FIG. 2. The downward extending portion of the tool is also provided with a notch 26 as most clearly depicted in FIGS. 5, 6, 9 and 10. The notch is of such width and depth which will allow the sides of the notch to straddle the flange 10*d* of the gutter and with the bottom of the notch resting against the top of the flange 10*d* when the contoured surface of the tool is directly adjacent to the ogee 10*c* of the gutter. The location and relationship of the locating surfaces of the tool when inserted in the gutter are as best depicted in FIG. 2.

Although within the scope of the invention the tool may be made of other materials such as hard wood or metal, and may be made by other methods of fabrication such as by injection molding, the applicants fabricated tools from one inch thick sheets of plastic material. A template was made and used to scribe the plastic sheet with the contour to fit adjacent to the ogee 10*c* on the gutter, and also the location and configuration of the notch 26 which was to rest against the flange 10*d* of the gutter. As is well known by those experienced in machining plastic materials, great care must be exercised not to allow the plastic material adjacent to cutting tools to become hot enough to melt, because the melted plastic material will adhere and bond to the cutting edges of the cutting tools.

Figure 3:
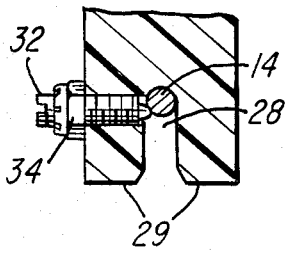
FIG. 3 is a vertical cross-section along line 3—3 of FIG. 2.
Figure 4:
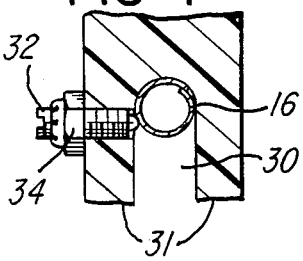
FIG. 4 is a vertical cross-section along line 4—4 of FIG. 2.

As depicted in FIGS. 1 and 2, and as most clearly seen in FIGS. 3 and 4, slots are milled upward from the bottom of the tool 20 leaving two pairs of side members 29 and 31 extending downward from the handle portion of the tool. The narrower slot 28, which formed the side members 29 and is best depicted in FIG. 3, is milled to be slightly wider than the diameter of nail 14 and to have a semi-circular bottom to receive the nail.

The wider slot 30, as most clearly seen in FIG. 4, which formed side members 31 and is milled to be slightly wider than the diameter of the ferrule 16 and to have a semi-circular bottom to receive the ferrule. The depth relationship of the slots should be such that when the nail and the ferrule are positioned as shown in FIG. 2, the nail and the ferrule are substantially on a common longitudinal axis.

The nail 14 may be inserted in the tool before the tool is positioned in the gutter. The ferrule is too long to insert in the tool before the tool is inserted in the gutter. The ferrule must be within the gutter before the tool is inserted, with the ferrule entering the slot 30.

Both the nail and the ferrule are held in position as depicted in FIG. 2 by holding means such as the spring plungers 32 as is most clearly seen in FIGS. 3 and 4. Spring plungers are available at all tool supply companies. The spring plungers, having spherical spring loaded tips, are located in the tool to be slightly below the horizontal center-line of the nail and the ferrule, and are longitudinally adjusted to hold the nail and the ferrule in position as shown in FIG. 2. When the tool is removed as shown in the right hand portion of FIG. 1, the springs in the spring plungers are slightly compressed and the tool is free to be removed from the nail and the ferrule. After the spring plungers are adjusted to proper position, they are locked in position by means of lock nuts 34.

Since the ferrule cannot be properly positioned before the tool is inserted in the gutter, the ferrule must be properly positioned after the tool is in place. A suitable transverse aperture 36 as shown in FIG. 2 is provided for this purpose. A finger may be inserted through this aperture and the ferrule snapped into position against the resistance from the spring plunger.

FIGS. 5, 6, 7, and 8 depict a variation of the installation tool 20 which was depicted in FIGS. 1–4, for which reason like elements carry the same numbers. The installation tool 40 has the identical handle with aperture 24.

The principal differences are that one of the side members 29 of the tool 20 has been shortened to become side member 29*a*, and side member 31 has been shortened to become side member 31*a*; spring plungers 32 and lock nuts 34 have been eliminated; and, the means for detachably retaining the nail 14 and the ferrule 16 has been changed. The tool 40 retains the contour for locating against the ogee of the gutter, and also retains the notch 26 which straddles and rests against the flange 10*d* of the gutter.

Figure 7:
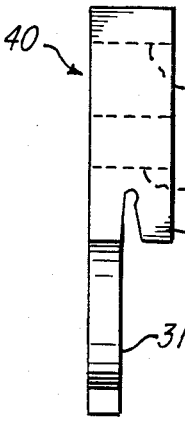
FIG. 7 is a vertical end view along line 7—7 of FIG. 6.
Figure 8:
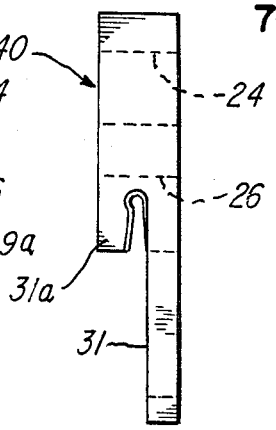
FIG. 8 is a vertical end view along line 8—8 of FIG. 6.

The restrictions for detachably holding the nail and the ferrule are as depicted in FIGS. 7 and 8. These restrictions are to make the horizontal distance of the openings adjacent to the nail and the ferrule directly below the horizontal diameter of each to be slightly less than the diameters of the nail and the ferrule. The shortened side members 29*a* and 31*a* may be tapered as illustrated in FIGS. 7 and 8. This produces the same holding effect as produced by the spring plungers in tool 20. After the nail has been partially driven into the building portion 12, pulling upward on the tool will cause the side members to spread enough to permit withdrawal of the tool from the nail and the ferrule.

Figure 5:
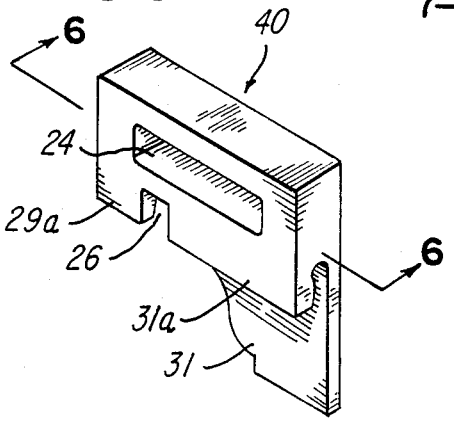
FIG. 5 is a perspective of a variation of the tool depicted in FIG. 1.
Figure 6:
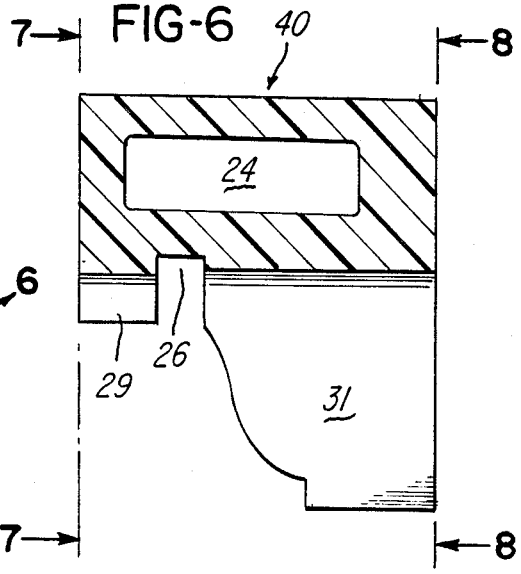
FIG. 6 is a vertical cross-section along line 6—6 of FIG. 5.
Figure 9:
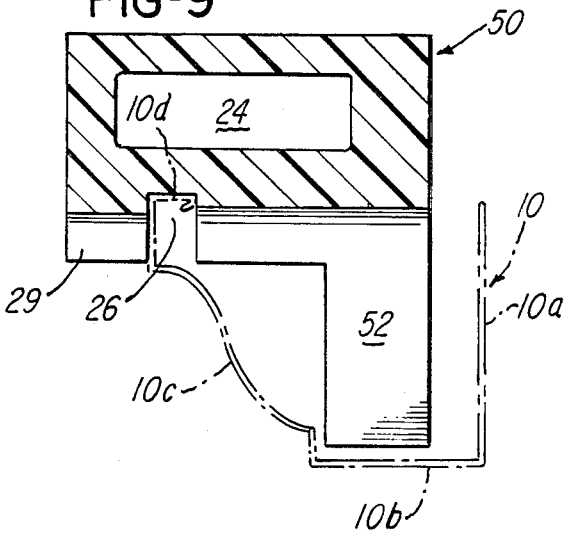
FIG. 9 is a vertical cross-section comparable to FIG. 6 and depicting contour changes in the lower portion thereof.

FIG. 9 depicts installation tool 50 which is a variation of tool 40 depicted in FIG. 5. The only difference is that the side member of the installation tool 40 which locates adjacent to the ogee of the gutter has been replaced by side member 52 which rests against the bottom 10*b* of the gutter.

Figure 10:
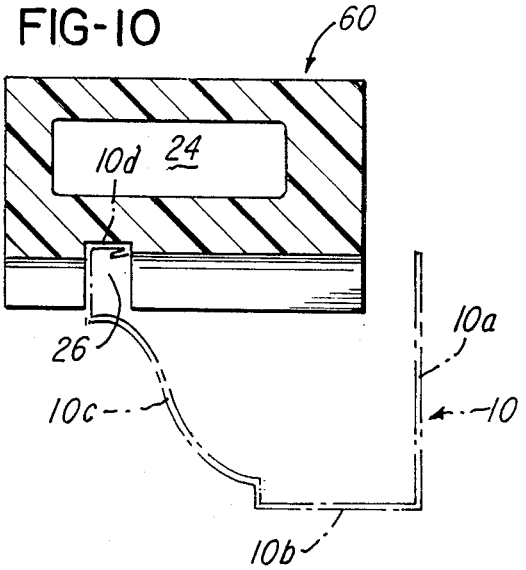
FIG. 10 is a vertical cross-section comparable to FIG. 9 and depicting omission of the lower portion of FIG. 9; and, FIG. 11 is a perspective of an installation tool which is functionally identical to the installation tools of the prior configurations, and which may be die-formed from a single piece of sheet metal.

FIG. 10 depicts installation tool 60 which is a variation of tool 50 which is depicted in FIG. 9. The only difference between tool 50 and tool 60 is that the side member 52 of tool 50 is omitted. Tool 60, as depicted in FIG. 10, engages only the flange portion 10*d* of the gutter.

Figure 11:
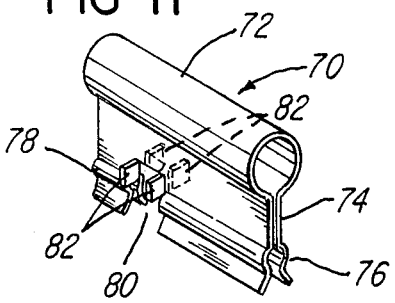

FIG. 11 depicts installation tool 70 which is the functional equivalent of installation tool 60 which was depicted in FIG. 10. Installation tool 70 may be formed in progressive dies from a single sheet of metal and has a handle portion 72, a downward extending portion 74 which terminates in means 76 for detachably holding a ferrule, and means 78 for detachably holding a nail. Tool 70 is provided with a notch 80 comparable to notch 26 in the tools previously described, and for the same purpose; that is, to straddle and rest on top of the flange 10*d* of the gutter. The metal displaced in forming the notch 80 may be bent into tabs 82 which give stability when the tool is positioned on the gutter.

It is to be understood that the embodiments of the present invention as shown and described are to be regarded as merely illustrative, and that the invention is susceptible to variations, modifications and changes, without regard to specific construction methods, within the scope of the appended claims.

We claim:

1. A gutter installation tool for positioning on a gutter being installed onto a building portion and detachably holding and positioning a gutter nail and gutter ferrule, said gutter installation tool comprising; a handle having means thereon for locating against a portion of said gutter, and further having means thereon for detachably holding and positioning a gutter ferrule within said gutter and means thereon for detachably holding and positioning a gutter nail outside of said gutter to be in substantial coaxial longitudinal alignment with said ferrule, said installation tool being detachable after said nail has been partially driven into said building portion.

2. A gutter installation tool in accordance with claim 1 in which said installation tool is of non-metallic material.

3. A gutter installation tool in accordance with claim 1 in which said installation tool is formed from sheet metal.

* * * * *